US006630936B1

(12) United States Patent
Langendorf

(10) Patent No.: US 6,630,936 B1
(45) Date of Patent: Oct. 7, 2003

(54) MECHANISM AND METHOD FOR ENABLING TWO GRAPHICS CONTROLLERS TO EACH EXECUTE A PORTION OF A SINGLE BLOCK TRANSFORM (BLT) IN PARALLEL

(75) Inventor: Brian K. Langendorf, El Dorado Hills, CA (US)

(73) Assignee: Intel Corporation, Santa Clara, CA (US)

( * ) Notice: Subject to any disclaimer, the term of this patent is extended or adjusted under 35 U.S.C. 154(b) by 393 days.

(21) Appl. No.: 09/671,237

(22) Filed: Sep. 28, 2000

(51) Int. Cl.[7] ..... G09G 5/37

(52) U.S. Cl. ..... 345/562; 345/505; 345/520; 345/531

(58) Field of Search ..... 345/501–506, 345/519–520, 522, 530–574, 582

(56) References Cited

U.S. PATENT DOCUMENTS 5,640,578 A * 6/1997 Balmer et al. ..... 395/562
5,919,256 A * 7/1999 Widigen et al. ..... 712/218
5,940,087 A 8/1999 Katsura et al.
5,943,064 A * 8/1999 Hong ..... 345/502
5,995,121 A 11/1999 Alcorn et al.
6,008,823 A 12/1999 Rhoden et al.
6,389,504 B1 * 5/2002 Tucker et al. ..... 711/100

* cited by examiner

*Primary Examiner*—Kee M. Tung
(74) *Attorney, Agent, or Firm*—Antonelli, Terry, Stout & Kraus, LLP; Hung H. Bui, Esq.

(57) ABSTRACT

A computer system having multiple graphics controllers configured to share graphics and video functions, including each executing a portion of a single block transform "BLT" operation in parallel to transfer a block of pixel data from a source to a destination on a graphics surface; and multiple local memories connected to the graphics controllers and configured to store pixel data of a source in a designated pattern allocated to different graphics controllers, wherein each includes a scratch pad for storing, upon request to execute a single BLT operation, all pixel data of the source that are in regions controlled by another graphics controller and copied from the other local memory.

30 Claims, 6 Drawing Sheets

MECHANISM AND METHOD FOR ENABLING TWO GRAPHICS CONTROLLERS TO EACH EXECUTE A PORTION OF A SINGLE BLOCK TRANSFORM (BLT) IN PARALLEL

TECHNICAL FIELD

The present invention relates to computer system architecture, and more particularly, relates to a mechanism and a method for enabling two graphics controllers to each execute in parallel a portion of a single block transform (BLT) in a computer system.

BACKGROUND

One of the most common operations in computer graphics applications is the Block Transform (often referred to as a "BLT" or "pixel BLT") used to transfer a block of pixel data from one portion (the "source" 12) of a graphics surface 10 of a display memory to another (the "destination" 14) as shown in FIG. 1. A series of source addresses are generated along with a corresponding series of destination addresses. Source data (pixels) are read from the source addresses, and then written to the destination addresses. In addition to simply transferring data, a BLT operation may also perform a logical operation on the source data (pixels) and other OPEPAND(s) (often referred to as a raster operation, or ROP). ROPs and BLTs are discussed in Computer Graphics Principles and Practice, Second Edition, by Foley, VanDam, Feiner and Hughes, Addison-Wesley Publishing Company, Inc., 1993, pp. 56–60. BLT operations are commonly used in creating or manipulating images in computer systems, such as color conversion, stretching and clipping of images. The implementation of a ROP in conjunction with a BLT operation is typically performed by coupling source and/or destination data to one or more logic circuits which perform a logical operation according to a ROP command requested. There are numerous possible types of ROPs used to combine the source data, pattern and destination data. See Richard F. Ferraro, Programmer's Guide to the EGA, VGA and Super VGA Cards, Third Edition, Addison-Wesley Publishing Company, Inc., 1994, pp. 707–712. In addition to standard logic ROPs, arithmetic addition or subtraction has also been implemented in computer systems. Similarly, a common "Windows" pattern known as a brush may also be included in addition to destination data. The brush pattern is typically a square of pixels arranged in rows which is used for background fill in windows on a display screen. The brush pattern may be copied to the destination data, or may be combined with the destination data in other ways, depending on the type of ROPs specified.

BLT and related operations are typically performed along with other graphics operations by specialized hardware of a computer system, such as a graphics controller. The particular hardware that undertakes BLT and related operations is commonly referred to as a graphics engine which resides in the graphics controller. Basic BLT operations (with a ROP) may include general steps of: reading source data from the source 12 to a temporary data storage, optionally reading destination data or other OPERAND data from its location, performing the ROP on the data, and writing the result to the destination 14.

The source 12 and destination 14 may be allowed to overlap in an overlap region 16 as shown in FIG. 2. The value of the source pixels and destination pixels prior to the BLT operation must, however, be used to calculate the new value of the destination pixels. In other words, the state of the graphics surface 10 after the BLT operation must be as if the result were first calculated and stored into a temporary data storage for the entire destination 14 and then copied to the destination 14.

Conventional computer systems deal with overlapping source 12 and destination 14 by copying the "leading edge" of the source 12 to the destination 14. As a result, all pixels are read as a source 12 before being written as a destination 14. However, if an additional graphics controller is incorporated into, or plugged-in an expansion board of an existing computer system for advanced graphics applications, synchronization and coherency problems exist with two graphics controllers working on the same surface simply to get the correct result, even if performance were not an issue. If the operation is serialized to ensure that pixels that are both source and destination are read as a source before being written as a destination, then the performance advantage of multiple graphics controllers in a single computer system will be reduced.

Accordingly, a need exists for multiple graphics controllers in a hybrid model computer system to establish proper synchronization, and to efficiently allocate and share the same image rendering tasks for coherency, particularly when dealing with overlapping source and destination regions during BLT and related operations.

BRIEF DESCRIPTION OF THE DRAWINGS

A more complete appreciation of exemplary embodiments of the present invention, and many of the attendant advantages of the present invention, will become readily apparent as the same becomes better understood by reference to the following detailed description when considered in conjunction with the accompanying drawings in which like reference symbols indicate the same or similar components, wherein.

DETAILED DESCRIPTION

The present invention is applicable for use with all types of computer systems, processors, video sources and chipsets, including follow-on chip designs which link together work stations such as computers, servers, peripherals, storage devices, and consumer electronics (CE) devices for computer graphics applications. However, for the sake of simplicity, discussions will concentrate mainly on a computer system having a basic graphics/multimedia platform architecture of multi-media graphics engines executing in parallel to deliver high performance video capabilities, although the scope of the present invention is not limited thereto. The term "graphics" may include, but may not be limited to, computer-generated images, symbols, visual representations of natural and/or synthetic objects and scenes, pictures and text.

Figure 3:
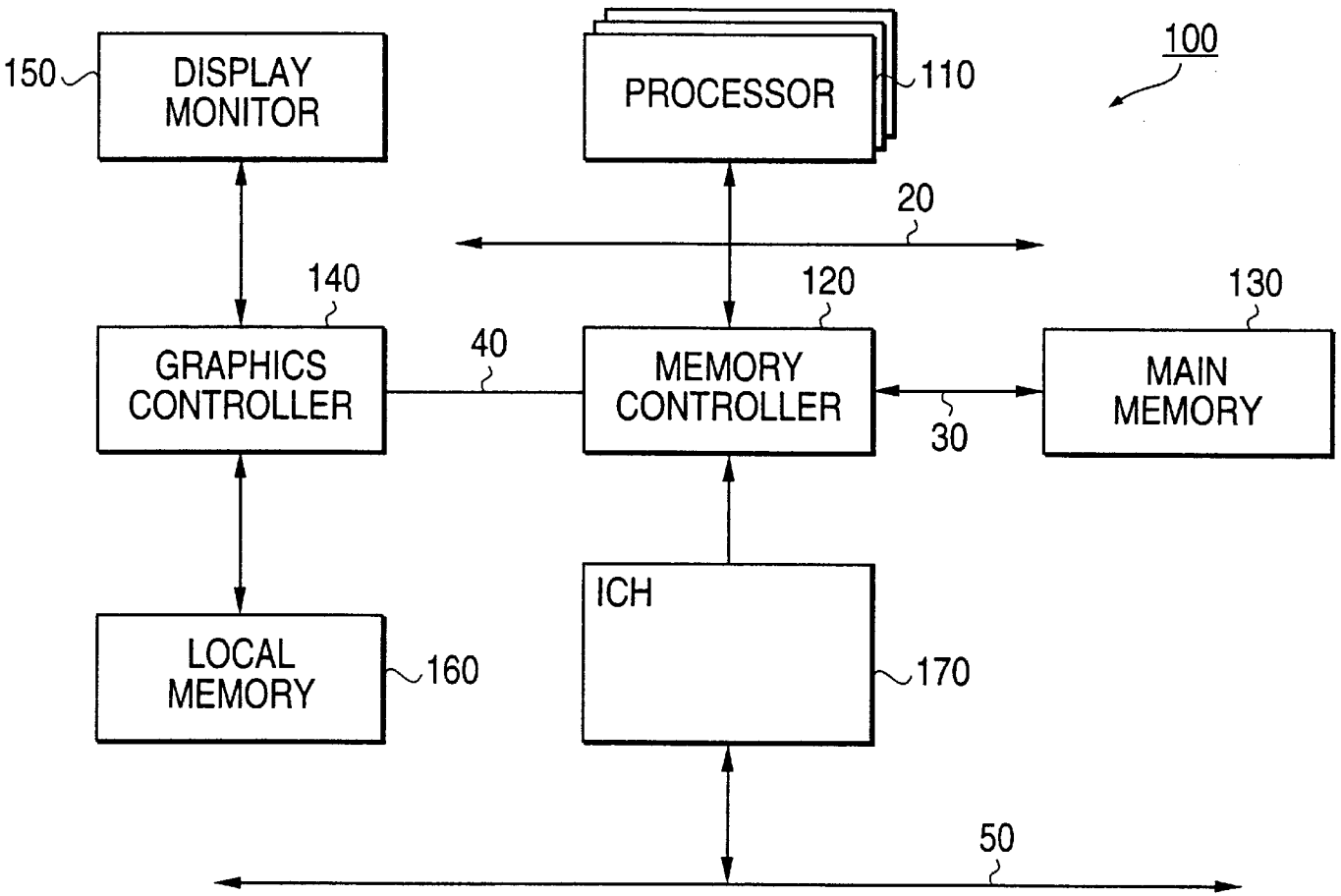
FIG. 3 illustrates a block diagram of an example computer system having an example graphics/multimedia platform.

For example, FIG. 3 illustrates an example computer system 100 having a basic graphics/multimedia platform for performing BLT operation. As shown in FIG. 3, the computer system 100 (which can be a system commonly referred to as a personal computer or PC) may include one or more processors or central processing units (CPU) 110 such as Intel® i386, i486, Celeron™ or Pentium® processors, a memory controller 120 connected to one or more processors 110 via a front side bus 20, a main memory 130 connected to the memory controller 120 via a memory bus 30, a graphics controller 140 connected to the memory controller 120 via a graphics bus 40 (e.g., Advanced Graphics Port "AGP" bus), and an IO controller hub (ICH) 170 connected to the memory controller 120 for access to a variety of I/O devices and the like, such as: a Peripheral Component Interconnect (PCI) bus 50. The PCI bus 50 may be a high performance 32 or 64 bit synchronous bus with automatic configurability and multiplexed address, control and data lines as described in the latest version of "PCI Local Bus Specification, Revision 2.1" set forth by the PCI Special Interest Group (SIG) on Jun. 1, 1995 for added-on a arrangements (e.g., expansion cards) with new video, networking, or disk memory storage capabilities.

The graphics controller 140 may be used to perform BLT and related operations and to control a visual display of graphics and/or video images on a display monitor 150 (e.g., cathode ray tube, liquid crystal display and flat panel display). A local memory 160 (i.e., a frame buffer) may be a separate memory dedicated to graphics applications. Such a local memory 160 may be coupled to the graphics controller 140 for storing pixel data from the graphics controller 140, one or more processors 110, or other devices within the computer system 100 for a visual display of video images on the display monitor 150.

Alternatively, the memory controller 120 and the graphics controller 140 may be integrated as a single graphics and memory controller hub (GMCH) including dedicated multimedia engines executing in parallel to deliver high performance 3D, 2D and motion compensation video capabilities. The GMCH may be implemented as a PCI chip such as, for example, PIIX4® chip and PIIX6® chip manufactured by Intel Corporation. In addition, such a GMCH may also be implemented as part of a host chipset along with an I/O controller hub (ICH) and a firmware hub (FWH) as described, for example, in Intel® 810 and 8XX series chipsets.

Figure 4:
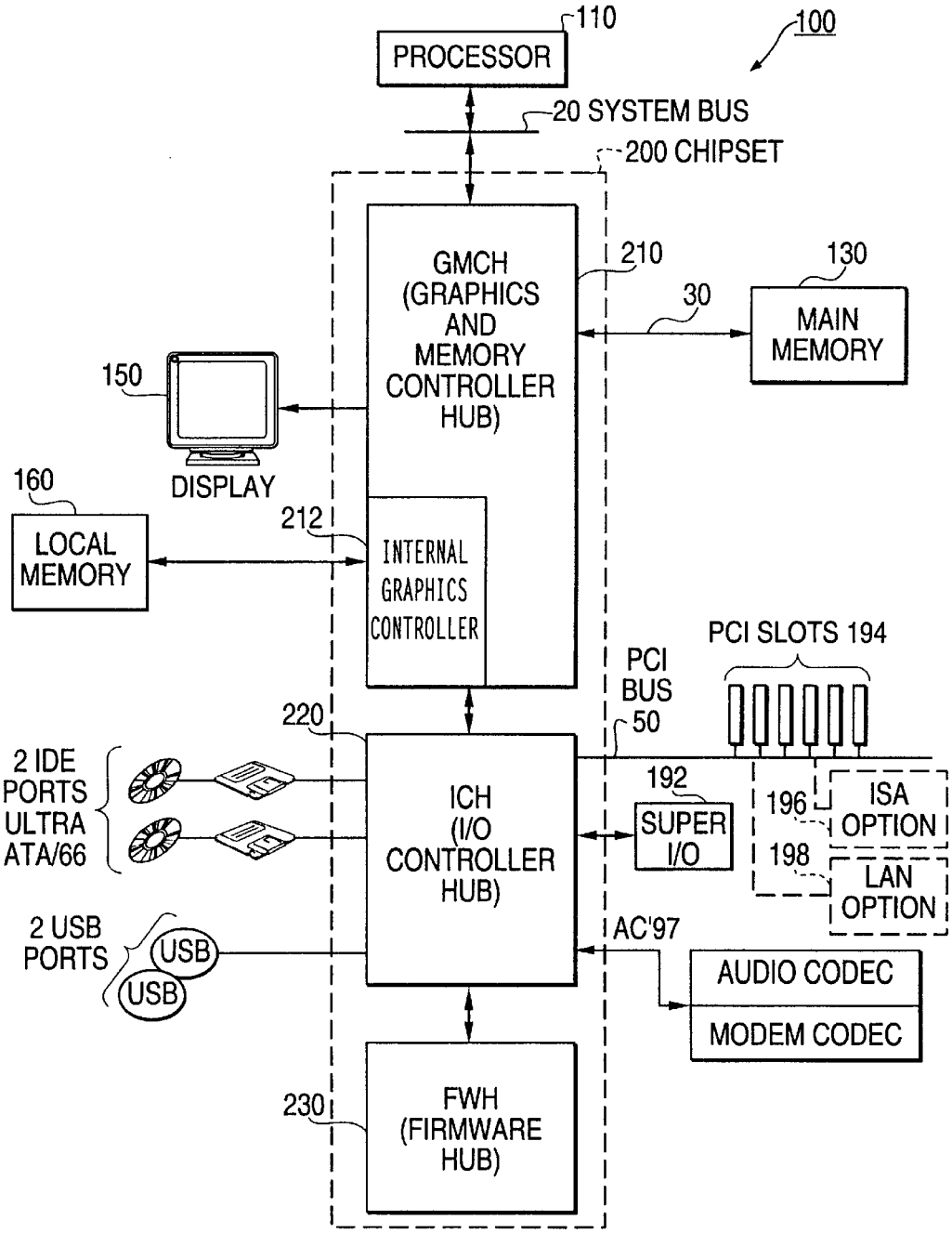
FIG. 4 illustrates a block diagram of an example computer system having a host chipset with an internal graphics controller according to an embodiment of the present invention.

FIG. 4 illustrates an example computer system 100 including such a host chipset 200. The computer system 100 includes essentially the same components shown in FIG. 3, except for the host chipset 200 which provides a highly-integrated three-chip solution consisting of a graphics and memory controller hub (GMCH) 210, an input/output (I/O) controller hub (ICH) 220 and a firmware hub 230 (FWH) 230.

The GMCH 210 incorporates therein an internal graphics controller 212 for graphics applications and video functions and for interfacing one or more memory devices to the system bus 20. The internal graphics controller 212 of the GMCH 210 may include a 3D (texture mapping) engine (not shown) for performing a variety of 3D graphics functions, including creating a rasterized 2D display image from representation of 3D objects, and a graphics engine (not shown) for performing 2D functions, including Block Transform (BLT) operations which transfer pixel data between memory locations on a graphics surface, a display engine (not shown) for displaying video or graphics images, and a digital video output port for outputting digital video signals and providing connection to traditional display monitor 150 or new space-saving digital flat panel display (FPD).

The GMCH 210 may be interconnected to any of a main memory 130 via a memory bus 30, a local memory 160, a display monitor 150 and to a television (TV) via an encoder and a digital video output signal. GMCH 120 maybe, for example, an Intel® 82810 or 82810-DC100 chip. The GMCH 120 also operates as a bridge or interface for communications or signals sent between one or more processors 110 and one or more I/O devices which may be connected to ICH 220.

The ICH 220 interfaces one or more I/O devices to GMCH 210. FWH 230 is connected to the ICH 220 and provides firmware for additional system control. The ICH 220 may be for example an Intel® 82801 chip and the FWH 230 may be for example an Intel® 82802 chip.

The ICH 220 may be connected to a variety of I/O devices and the like, such as: a Peripheral Component Interconnect (PCI) bus 50 (PCI Local Bus Specification Revision 2.2) which may have one or more I/O devices connected to PCI slots 194, an Industry Standard Architecture (ISA) bus option 196 and a local area network (LAN) option 198; a Super I/O chip 192 for connection to a mouse, keyboard and other peripheral devices (not shown); an audio coder/decoder (Codec) and modem Codec; a plurality of Universal Serial Bus (USB) ports (USB Specification, Revision 1.0); and a plurality of Ultra/66 AT Attachment (ATA) 2 ports (X3T9.2 948D specification; commonly also known as Integrated Drive Electronics (IDE) ports) for receiving one or more magnetic hard disk drives or other I/O devices.

The USB ports and IDE ports may be used to provide an interface to a hard disk drive (HDD) and compact disk read-only-memory (CD-ROM). I/O devices and a flash memory (e.g., EPROM) may also be connected to the ICH of the host chipset for extensive I/O supports and functionality. Those I/O devices may include, for example, a keyboard controller for controlling operations of an alphanumeric keyboard, a cursor control device such as a mouse, track ball, touch pad, joystick, etc., a mass storage device such as magnetic tapes, hard disk drives (HDD), and floppy disk drives (FDD), and serial and parallel ports to printers and scanners. The flash memory may be connected to the ICH of the host chipset via a low pin count (LDC) bus. The flash memory may store a set of system basic input/output start up (BIOS) routines at startup of the computer system 100. The super I/O chip 192 may provide an interface with another group of I/O devices.

In either embodiment of an example computer system as shown in FIGS. 3 and 4, the graphics controller 140 of FIG. 3, or the internal graphics controller 212 of FIG. 4 may be used solely for graphics applications, including controlling "BLT" and related operations to transfer a block of pixel data from one portion (source) of a graphics surface to another (destination). When there is an overlap between the source and destination as described with reference to FIG. 2, either the graphics controller 140 of FIG. 3, or the internal graphics controller 212 of FIG. 4 is configured to copy the "leading edge" of the overlap region first. For example, the column of pixels at the right edge of the source 12 may first be copied to the right edge of the destination 14, then the column of pixels second to the right, etc. As a result, all pixels are read as a source 12 before being written as a destination 14.

Figure 5:
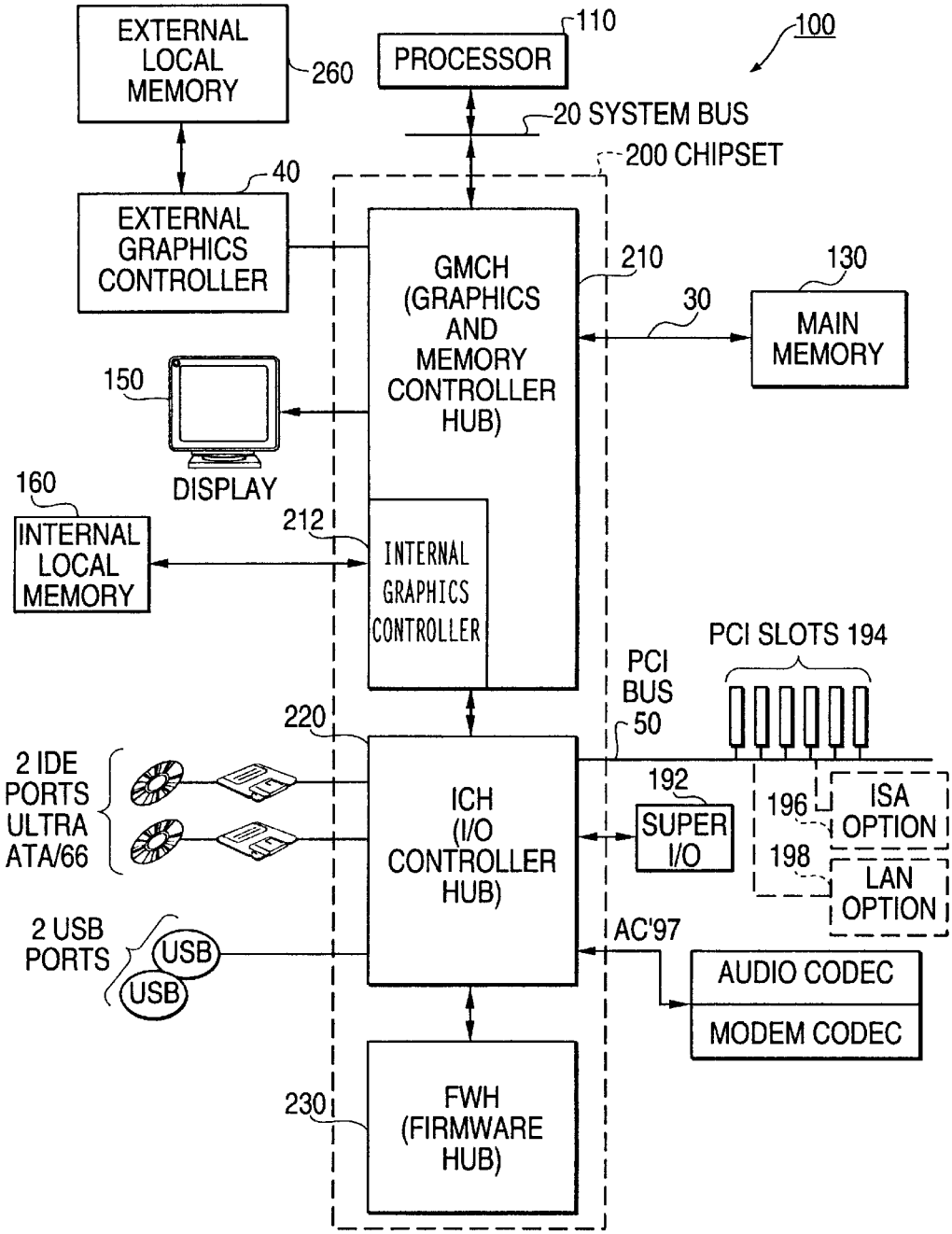
FIG. 5 illustrates a block diagram of an example computer system having a hybrid host chipset with an internal graphics controller and an external graphics controller according to an embodiment of the present invention.
Figure 6:
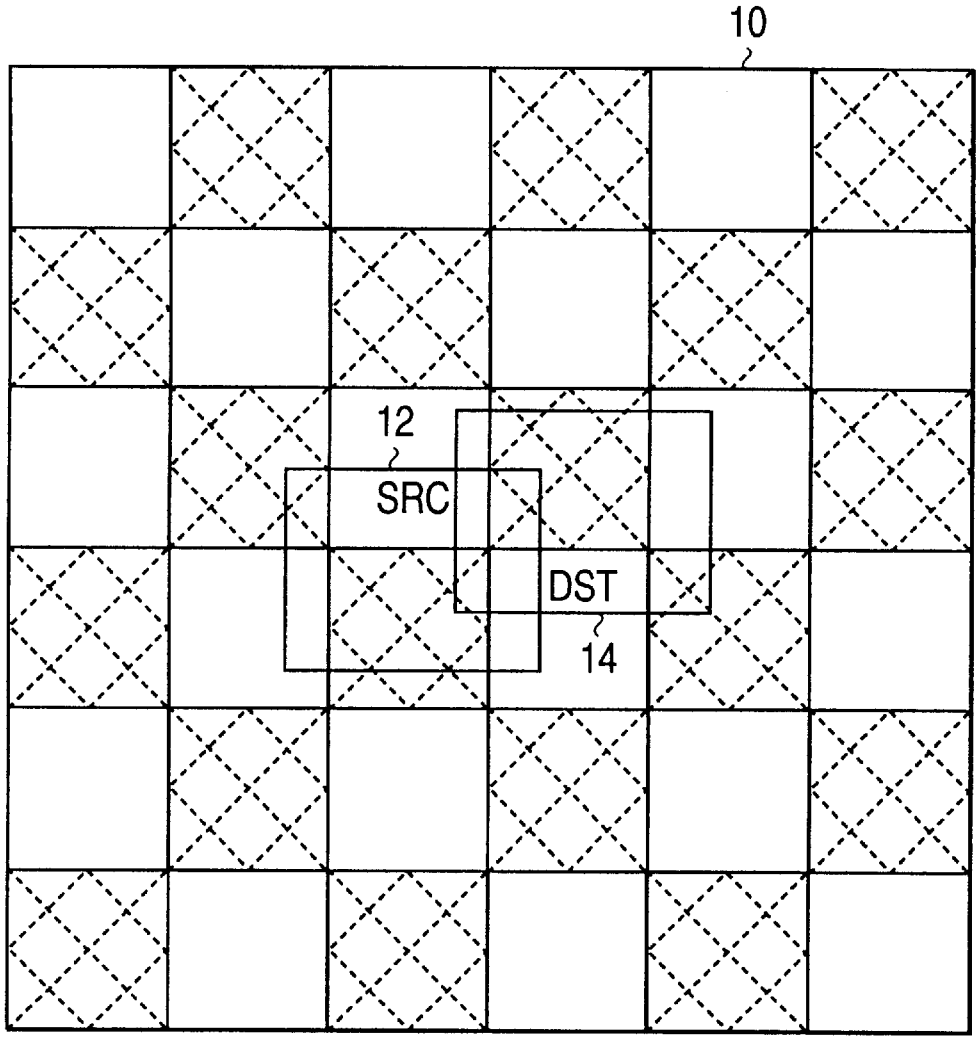
FIG. 6 illustrates an example graphics surface divided between an internal graphics controller and an external graphics controller according to an embodiment of the present invention.

However, if an additional graphics controller 240 and related local memory 260 are incorporated into, or plugged-in an expansion board (i.e., PCI slots 194) of an existing computer system as shown in FIG. 5 for advanced and accelerated graphics applications and for reducing the time required to process the BLT operation, not only the graphics surface 10 needs to be shared between the internal (host) graphics controller 212 and the external (remote) graphics controller 240 for BLT and related operations as shown in FIG. 6, but synchronization and coherency problems between the internal (host) graphics controller 212 and the external (remote) graphics controller 240 are also introduced.

For example, the additional graphics controller 240 may be, but not required to be, plug-and-play devices. In addition, the second graphics engine may also be built into the system from the beginning, perhaps in the case of a workstation product. All that is required for the invention to be applicable is that the system have two graphics engines that perform BLT operations asynchronously to each other. In other words, while the two graphics engines may use a common clock and therefore operate synchronously at the clock level, each graphics engine does not have detailed knowledge of the progress the other has made in performing a command or possibly even its progress within a command list. Synchronization and coherency problems are introduced simply because there are two independent graphics engines cooperating to perform the BLT operations. Likewise, BLT operations can be performed faster if both graphics engines are used rather than only one graphics engine is present or used.

FIG. 6 illustrates an example allocation of a graphics surface 10 in a checkerboard pattern shared between the internal (host) graphics controller 212 and the external (remote) graphics controller 240 for performing BLT and related operations. The internal (host) graphics controller 212 and host local memory 160 may be assigned to handle all the checkerboard regions that are squiggled. Likewise, the external (remote) graphics controller 240 and remote local memory 260 may be assigned to handle all the checkerboard regions that are not squiggled, or vice versa. The checkerboard pattern serves only to illustrate the division of the effort between the internal (host) graphics controller 212 and the external (remote) graphics controller 240. Other patterns such as hash patterns may also be used as long as the graphics surface 10 is divided between the internal graphics controller 212 and the external graphics controller 240.

When a BLT operation is to be performed on a given source pixel in a "horizontal" region may be associated with a destination pixel in a "vertical" region or vice-versa. In such situations, a decision must be made as to which graphics controllers 212 and 240 may perform the BLT operation for this pixel. A destination dominant policy may be chosen in which the graphics controller that is responsible for the region of the graphics surface 10 that contains the destination pixel is responsible for performing the BLT operation for that pixel. However, synchronization and coherency problems still exist regardless of how the pixels are divided.

There are BLT operations for which a pixel will be a destination for external graphics controller 240 and a source for internal graphics controller 212. External graphics controller 240 cannot write the pixel until such a pixel has been read by internal graphics controller 212. Similar situations arise for pixels that are a destination for internal graphics controller 212 and a source for external graphics controller 240. If the operation is serialized to ensure that pixels that are both source 12 and destination 14 are read as a source before being written as a destination, then the performance advantage of multiple graphics controllers 212 and 240 in the hybrid model computer system 100 will be nullified.

Figure 7:
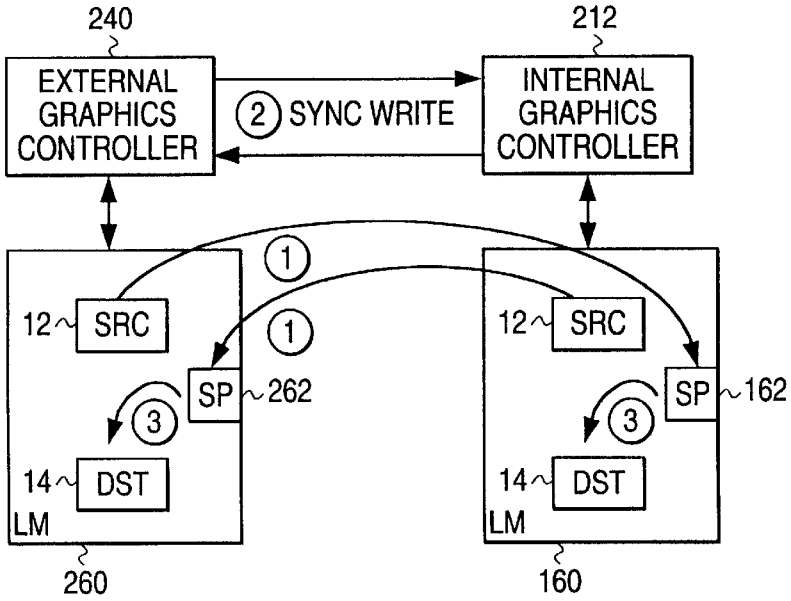
FIG. 7 illustrates a mechanism for enabling two (internal and external) graphics controllers to each execute in parallel a portion of a single block transform (BLT) operation according to an embodiment of the present invention.

Turning now to FIG. 7, a mechanism and a method for enabling two (internal and external) graphics controllers 212 and 240 to each execute in parallel a portion of a single BLT operation in a hybrid model computer system 100 according to an embodiment of the present invention are illustrated. In general, each graphics controller 212 or 240 first copies all source pixels that are in regions controlled by the other graphics controller 240 or 212, and indicates to the other that the copy has been made. In general, one graphics controller 212 or 240 must signal the other graphics controller 240 or 212 that the copy has been made. Possible ways of transmitting this information include: 1) writing to a memory mapped I/O location in the other graphics controller; 2) the location written may convey the information and the data value written has no meaning; 3) the location written may have several uses and the value written indicates that the BLT copy synchronization is what is being communicated; 4) writing to an actual memory location that the other graphics controller may poll; 5) asserting a special signal for signaling the other graphics controller that the copy has been made; and 6) transmitting a private special cycle over a bus (such as PCI or AGP bus).

Each graphics controller 212 or 240 then must wait for a synchronization write before it begins updating any of its destination pixels that are sources for the other graphics controller 240 or 212. Any pixels that are destinations for one graphics controller 212 or 240 and are not sources for the other graphics controller 240 or 212 may be updated at any time. As a result, the two (internal and external) graphics controller 212 and 240, and respective local memories 160 and 260 in a hybrid model computer system 100 are able to establish proper synchronization and to efficiently allocate and share the same image rendering tasks for coherency, particularly when dealing with overlapping source and destination regions during BLT and related operations.

As shown in FIG. 7, the mechanism 700 may include the internal graphics controller 212 and the external graphics controller 240 and respective local memories 160 and 260. The internal (host) graphics controller 212 has its own local memory 160 containing a scratch pad (SP) 162 which is a set of memory addresses set aside for storing pixel data copied from the external (remote) graphics controller 240 and memory regions for source 12 and destination 14. Likewise, the external (remote) graphics controller 240 has its own remote local memory 260 containing a scratch pad (SP) 262 which is a set of memory addresses set aside for storing pixel data copied from the internal (host) graphics controller 212 and memory regions for source 12 and destination 14. Alternatively, the scratch pad 162 and 262 may be located anywhere in the system, not just in respective local memory 160 and 160. For example, the scratch pad may be located on die, in the main memory 130 (see FIG. 3), and in the local memory of the other graphics controller. All that is required is that it is storage dedicated for this purpose for the duration of the BLT. The storage may even be used for other purposes when a cooperative BLT is not being performed. In addition, a single local memory dedicated to graphics may even be shared between the two (internal and external) graphics controllers. However, respective scratch pads may need to be independent.

Since the graphics surface 10 is divided between the internal (host) graphics controller 212 and the external (remote) graphics controller 240, each of the graphics controllers 212 and 240 may read remote pixels from the source into respective scratch pad (SP) 162 and 262. In other words, each of the graphics controllers 212 and 240 may scan the same source 12, determine all of the pixels in the source 12 that are not local that it needs to go to the other graphics controller and obtain those pixels from the other graphics controller's local memory.

Specifically, at the beginning of a BLT operation, each graphics controller scans the source rectangle for example, determines those pixels that are remote, copies those remote source pixels from the remote local memory into the local scratch pad (SP). Optionally only those remote source pixels that are also destination pixels need to be copied in order to reduce the overhead for cooperation. For example, if the source and destination does not overlap the BLT may proceed without the initial copy to the scratch pad (SP). The internal (host) graphics controller 212 then scans the source 12, finds all the pixels in the source 12 needed to calculate the destination 14, including all those pixels that are located in the remote local memory 260 attached to the external (remote) graphics controller 240, and sends a request to make a copy of all those remote source pixels into the host scratch pad (SP) 162 as shown in step#1 of FIG. 7. Likewise, the external (remote) graphics controller 240 also scans the same source rectangle 12, finds all the source pixels needed to calculate the destination 14, including all those pixels that are located in the host local memory 160 attached to the internal (host) graphics controller 212, and sends a request to make a copy of all those host source pixels into the remote scratch pad (SP) 262 as shown in step#1 of FIG. 7. Both the internal (host) graphics controller 212 and external (remote) graphics controller 240 may read remote pixels from the source into respective scratch pad (SP) 162 and 262 in either order or at the same time.

After the internal (host) graphics controller 212 and external (remote) graphics controller 240 are done copying remote source pixels into respective scratch pad (SP) 162 and 262, a synchronization write may be issued to respective internal (host) graphics controller 212 and external (remote) graphics controller 240 to indicate that the copy has been made at step#2. For example, when the internal (host) graphics controller 212 is done copying the remote source pixels to its scratch pad (SP) 162 of local memory 160, the internal (host) graphics controller 212 does a synchronization write at the external (remote) graphics controller 240. Likewise, when the external (remote) graphics controller 240 is done copying the remote source pixels to its scratch pad (SP) 262 of local memory 260, the external (remote) graphics controller 240 does a synchronization write at the internal (host) graphics controller 212. Synchronization write may represent a memory cycle for reading and/or writing pixel data into local memory. Until the synchronization write occurs, neither graphics controller 212 and 240 can proceed with the BLT operation. However, such a synchronization write may be skipped if the source and destination do not overlap. The entire mechanism only needs to be invoked if the source and destination overlap. The mechanism may be invoked for every BLT for simplicity at the cost of some performance do to overhead (copies to scratch pad and synchronization writes) that are not required.

Upon receipt of the synchronization write, either graphics controller 212 or 240 which has already completed its copy of remote source pixels needed to calculate destination 14, also knows that the other graphics controller has also made a copy of remote source pixels needed to calculate destination 14. As a result, either graphics controller 212 or 240 can update any of its destination pixels that are sources for the other graphics controller 240 or 212. Any pixels that are destinations for one graphics controller and are not sources for the other graphics controller may be updated at any time.

At step#3 of FIG. 7, either graphics controller 212 or 240 may use for the remote source pixels either those pixels that are stored in local memory 160 and 260 or the pixels that copied to the scratch pad (SP) 162 and 262 of respective local memory 160 and 260 to calculate the new value of the destination 14 and then write the destination 14 on a graphics surface 10. Pixels from the remote graphics memory may be used if they are included in the destination. For example, the internal (host) graphics controller 212 may use for the source pixels either those pixels that are stored in local memory 160 or the pixels that copied to the scratch pad (SP) 162 of the local memory 160 to calculate the destination pixels, scanning on a pixel-by-pixel basis in the opposite direction that the destination 14 is moved from the source 12 on a graphics surface 10. For example, if the source 12 is moved to the right and up to destination 14 as shown in FIG. 6, the internal (host) graphics controller 212 may start scanning in the upper left corner and then scan the pixels down and to the left. Similarly, if the source 12 is moved up more than right to destination 14, the internal (host) graphics controller 212 may start scanning vertically first and move towards the left.

Figure 1:
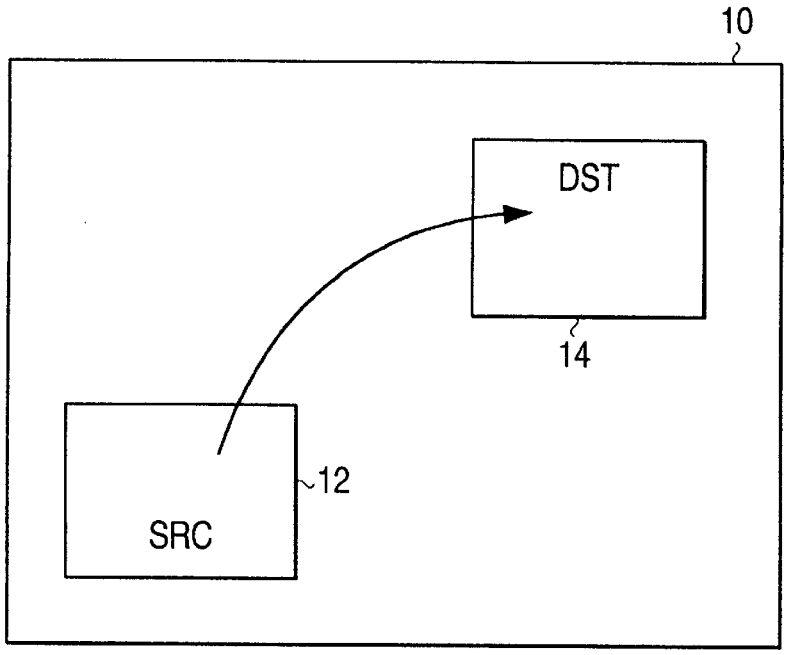
FIG. 1 illustrates an example Block Transform (BLT) operation for transferring a block of pixel data from a source to a destination on a graphics surface.
Figure 2:
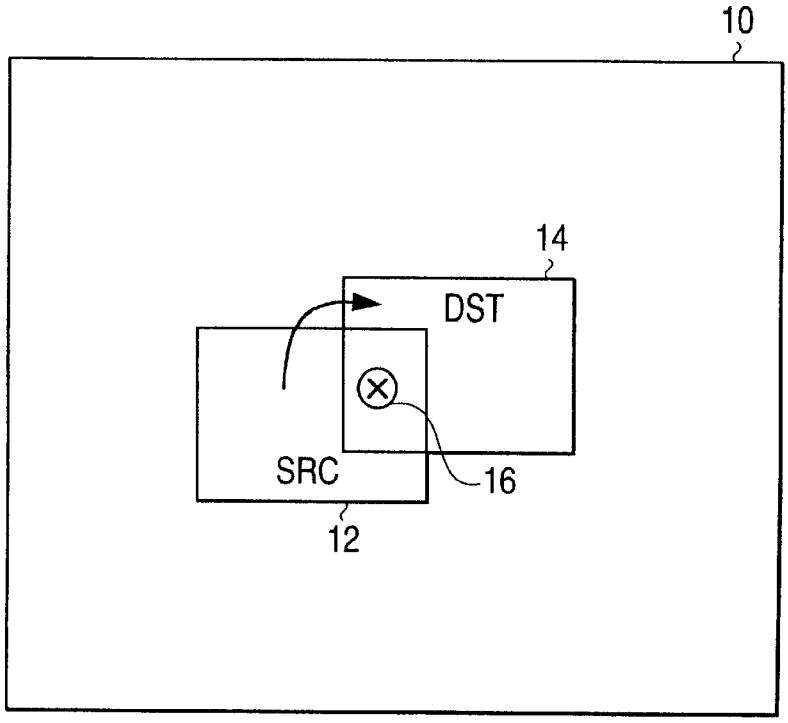
FIG. 2 illustrates an example Block Transform (BLT) operation for transferring a block of pixel data from a source to a destination on a graphics surface where there is an overlap between the source and the destination.

In the event of an overlap between the source 12 and destination 14 as shown in FIG. 2, the overlapped area problem can simply be solved by common scanning techniques of just noting a particular direction that the destination 14 has been moved relative to the source 12 and scanning the source rectangle in the opposite direction. As a result, synchronization and coherency problems between the internal (host) graphics controller 212 and the external (remote) graphics controller 240 can be advantageously eliminated.

Figure 8:
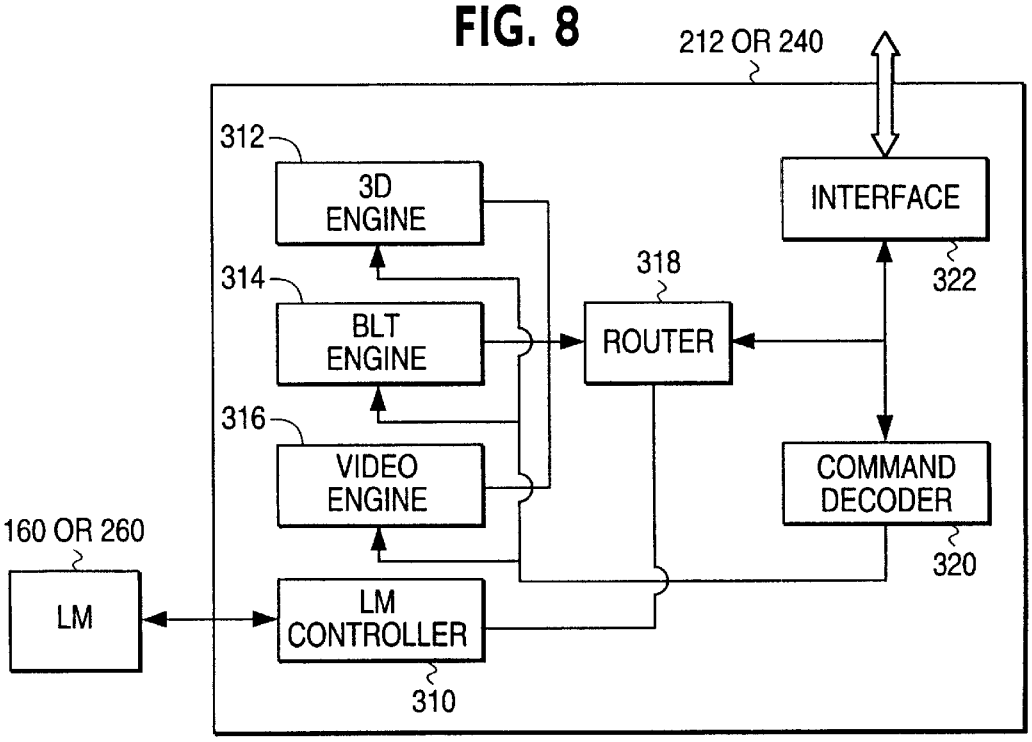
FIG. 8 illustrates a block diagram of an example graphics controller according to an embodiment of the present invention.

FIG. 8 illustrates a block diagram of an example graphics controller 212 or 240 and related local memory 160 or 260 according to an embodiment of the present invention. As shown in FIG. 8, the graphics controller 212 or 240 may include a local memory controller 310 which controls access to local memory 160 or 260, a 3D (texture mapping) engine 312 which performs a variety of 3D graphics functions, including creating a rasterized 2D display image from representation of 3D objects, a graphics BLT engine 314 which performs 2D functions, including BLT and related operations which transfer pixel data between memory locations on a graphics surface 10, a display engine 316 which controls a visual display of video or graphics images, a router 318 which interacts with an operating system (OS) and plug-and-play devices to transform requests into memory addresses of local memory 160 or 260 for executing BLT and related operations, a command decoder 320 which decodes user commands, including BLT commands and issues threads of control to the local memory controller 310 and all the different engines 312, 314 and 316, and an interface 322 which provides an interface for communications or signals to/from one or more processors 110, via a AGP bus 40.

The graphics BLT engine 314 may be configured to request and execute requests for BLT and related operations under control of the command decoder 320. A request for a BLT to operation may be routed to a router 318 which has the ability to transform that request into a memory address which is part of a unified address space of the computer system 100. The memory address may refer to some specific memory locations in the local memory 160 or 260 attached to the graphics controller 212 or 240, or different memory locations in the computer system 100. If the memory address refers to specific memory locations in the local memory 160 or 260, then the router 318 may route the memory address to access the local memory 160 or 260 via the local memory controller 310. Alternatively, if the memory address refers to different memory locations in the computer system 100, then the router 318 may route the memory address, via the interface 322.

Specifically, the graphics BLT engine 314 may scan the source 12 at the local memory 160 or 260, find all the source pixels needed to calculate the destination 14, and send a request to make a copy of all source pixels into the local memory 160 or 260. The graphics BLT engine 314 may then wait for a synchronization write indicating that the copy has been made in order to calculate destination pixels and write the destination 14 on the graphics surface 10 in the manner as described with reference to FIG. 7.

As described from the foregoing, the present invention advantageously provides a mechanism and a method for enabling two graphics controllers to each execute in parallel a portion of a single BLT operation in a computer system with proper synchronization and coherency, particularly when dealing with overlapping source and destination regions during the BLT operation.

While there have been illustrated and described what are considered to be exemplary embodiments of the present invention, it will be understood by those skilled in the art and as technology develops that various changes and modifications may be made, and equivalents may be substituted for elements thereof without departing from the true scope of the present invention. Many modifications may be made to adapt the teachings of the present invention to a particular situation without departing from the scope thereof. For example, the mechanism for enabling two graphics controllers to each execute in parallel a portion of a single BLT operation may also be implemented by a software module or a comprehensive hardware/software module with a driver software configured to make a scratchpad copy of remote source pixels at respective graphics controllers, issue a synchronization write and execute BLT and related operations. Therefore, it is intended that the present invention not be limited to the various exemplary embodiments disclosed, but that the present invention includes all embodiments falling within the scope of the appended claims.

What is claimed is:

1. A graphics mechanism, comprising:

first and second graphics controllers configured to share graphics and video functions, including each executing a portion of a block transform "BLT" operation in parallel to transfer a block of pixel data from a source to a destination on a graphics surface of a display screen;

a memory device connected to said first and second graphics controllers and configured to store pixel data of said source on the graphics surface in a designated pattern allocated to said first graphics controller and said second graphics controller; and scratch pads each for storing, upon request to execute said BLT operation, all pixel data of said source that are in regions controlled by the other graphics controller and copied from said memory device.

2. The graphics mechanism as claimed in claim 1, wherein said memory device comprises:

a first local memory connected to said first graphics controller and configured to store pixel data of said source on the graphics surface in a designated pattern allocated to said first graphics controller; and a second local memory connected to said second graphics controller and configured to store pixel data of said source on the graphics surface in said designated pattern allocated to said second graphics controller.

3. The graphics mechanism as claimed in claim 2, wherein said scratch pads are included in respective first and second local memories for storing, upon request to execute said BLT operation, all pixel data of said source that are in regions controlled by another graphics controller and copied from the other local memory.

4. The graphics mechanism as claimed in claim 1, wherein said BLT operation includes a logical operation on pixel data of said source and other OPERAND(s) to obtain pixel data of said destination on the graphics surface.

5. The graphics mechanism as claimed in claim 2, wherein said BLT operation includes a logical operation on pixel data of said source and other OPERAND(s) to obtain pixel data of said destination on the graphics surface.

6. The graphics mechanism as claimed in claim 1, wherein said first graphics controller is integrated in a chipset, and said second graphics controller is plugged in an expansion card for advanced graphics applications.

7. The graphics mechanism as claimed in claim 6, wherein said first and second graphics controllers each includes a BLT graphics engine configured to perform BLT and related operations.

8. The graphics mechanism as claimed in claim 6, wherein each of said first and second graphics controllers first copies all pixel data of said source that are in regions controlled by the other graphics controller into respective scratch pad, issues a synchronization write to the other graphics controller to indicate that the copy has been made, and upon receipt of the synchronization write from the other graphics controller, starts updating any pixel data for said destination that are sources for the other graphics controller.

9. The graphics mechanism as claimed in claim 8, wherein any one of said first and second graphics controllers updates any pixel data for said destination that are not sources for the other graphics controller at any time.

10. The graphics mechanism as claimed in claim 8, wherein either of said first and second graphics controllers calculates a new value of said destination using pixel data of said source in said designated pattern allocated to either of said first and second graphics controllers respectively, or pixel data of said source that are copied, and writes said destination on the graphics surface of said designated pattern.

11. The graphics mechanism as claimed in claim 8, wherein said first and second graphics controllers each comprises:

a local memory controller which controls access to respective local memory;

a 3D (texture mapping) engine which performs a variety of 3D graphics functions, including creating a rasterized 2D display image from representation of 3D objects;

a graphics BLT engine which performs 2D functions, including said BLT operation to transfer a block of pixel data from said source to said destination on the graphics surface;

a display engine which controls a visual display of video or graphics images;

a router coupled to said local memory controller, said 3D engine, said graphics BLT engine, and said display engine, which interacts with an operating system (OS) to transform requests into memory addresses of said local memory for executing said BLT operation;

a command decoder which decodes user commands, including a BLT command, and issues threads of control to said local memory controller, said 3D engine, said graphics BLT engine, and said display engine; and an interface which provides an interface for communications or signals to/from one or more processors.

12. The graphics mechanism as claimed in claim 1, wherein said designated pattern of the graphics surface corresponds to a checkerboard with ½ of said checkerboard allocated to said first graphics controller and the other ½ of said checkerboard allocated to said second graphics controller.

13. A computer system, comprising:

one or more processors;

a display monitor having a display screen;

a chipset connected to said one or more processors, and including an internal graphics controller which processes video data for a visual display on said display monitor, and a local memory attached to said internal graphics controller; and an external graphics controller and a local memory coupled to said chipset, via an expansion card, and configured to share graphics and video functions with said internal graphics controller of said chipset, including executing a portion of a block transform "BLT" operation in parallel to transfer a block of pixel data from a source to a destination on a graphics surface of said display screen;

wherein each local memory of said internal and external graphics controllers is configured to store pixel data of said source on the graphics surface in a designated pattern allocated to a respective graphics controller, and includes a scratch pad for storing, upon request to execute said BLT operation, all pixel data of said source that are in regions controlled by the other graphics controller and copied from the other local memory.

14. The computer system as claimed in claim 13, wherein said BLT operation includes a logical operation on pixel data of said source and other OPERAND(s) to obtain pixel data of said destination on the graphics surface.

15. The computer system as claimed in claim 13, wherein said internal and external graphics controllers each includes a BLT graphics engine configured to perform BLT and related operations.

16. The computer system as claimed in claim 13, wherein said internal and external graphics controllers each first copies all pixel data of said source that are in regions controlled by the other graphics controller into respective scratch pad, issues a synchronization write to the other graphics controller to indicate that the copy has been made, and upon receipt of the synchronization write from the other graphics controller, starts updating any pixel data for said destination that are sources for the other graphics controller.

17. The computer system as claimed in claim 16, wherein any one of said internal and external graphics controllers updates any pixel data for said destination that are not sources for the other graphics controller at any time.

18. The computer system as claimed in claim 17, wherein either one of said internal and external graphics controllers calculates a new value of said destination using pixel data of said source in said designated pattern allocated to either of said internal and external graphics controllers respectively, or pixel data of said source that are copied, and writes said destination on the graphics surface of said designated pattern.

19. The computer system as claimed in claim 18, wherein said internal and external graphics controllers each comprises:

a local memory controller which controls access to respective local memory;

a 3D (texture mapping) engine which performs a variety of 3D graphics functions, including creating a rasterized 2D display image from representation of 3D objects;

a graphics BLT engine which performs 2D functions, including said BLT operation to transfer a block of pixel data from said source to said destination on the graphics surface;

a display engine which controls a visual display of video or graphics images;

a router coupled to said local memory controller, said 3D engine, said graphics BLT engine, and said display engine, which interacts with an operating system (OS) to transform requests into memory addresses of said local memory for executing said BLT operation;

a command decoder which decodes user commands, including a BLT command, and issues threads of control to said local memory controller, said 3D engine, said graphics BLT engine, and said display engine; and an interface which provides an interface for communications or signals to/from one or more processors.

20. The computer system as claimed in claim 13, wherein said designated pattern of the graphics surface corresponds to a checkerboard with ½ of said checkerboard allocated to said internal graphics controller and the other ½ of said checkerboard allocated to said external graphics controller.

21. A process of enabling multiple graphics controllers in a computer system to execute a portion of a block transform "BLT" operation in parallel, comprising:

enabling each graphics controller, upon receipt of a request to execute said BLT operation to transfer a block of pixel data from a source to a destination on a graphics surface of a designated pattern, to copy all source pixels that are in regions controlled by another graphics controller into a local memory;

enabling each graphics controller to issue a synchronization write to indicate that the copy has been made; and enabling each graphics controller, upon receipt of said synchronization write from the other graphics controller, to update any of destination pixels that are sources for the other graphics controller and execute said BLT operation.

22. The process as claimed in claim 21, wherein said BLT operation includes a logical operation on pixel data of said source and other OPERAND(s) to obtain pixel data of said destination on the graphics surface.

23. The process as claimed in claim 21, wherein any one of said multiple graphics controllers updates any pixel data for said destination that are not sources for the other graphics controller at any time.

24. The process as claimed in claim 21, wherein said designated pattern of the graphics surface corresponds to a checkerboard with ½ of said checkerboard allocated to one graphics controller and the other ½ of said checkerboard allocated to the other graphics controller.

25. A mechanism, comprising:

local memories; and multiple graphics engines to share graphics and video functions, including each to execute a portion of a block transform "BLT" operation in parallel to transfer a block of pixel data from a source to a destination on a graphics surface of a display screen in a designated pattern allocated to the multiple graphics engines;

wherein each graphics engine, upon a request to execute said BLT operation, first copies pixel data of said source that are in regions controlled by another graphics engine into a respective local memory, issues a synchronization write to the other graphics engine to indicate that the copy has been made, and upon receipt of the synchronization write from the other graphics engine, starts updating any pixel data for said destination that are sources for the other graphics engine.

26. The mechanism as claimed in claim 25, wherein any one of said graphics engines updates any pixel data for said destination that are not sources for the other graphics engine at any time.

27. The mechanism as claimed in claim 25, wherein either one of said graphics engines calculates a new value of said destination using pixel data of said source in said designated pattern allocated to either one of said graphics engines respectively, or pixel data of said source that are copied, and writes said destination on the graphics surface of said designated pattern.

28. The mechanism as claimed in claim 25, wherein each of said graphics engines comprises:

a local memory controller which controls access to respective local memory;

a 3D (texture mapping) engine which performs a variety of 3D graphics functions, including creating a rasterized 2D display image from representation of 3D objects;

a graphics BLT engine which performs 2D functions, including said BLT operation to transfer a block of pixel data from said source to said destination on the graphics surface;

a display engine which controls a visual display of video or graphics images;

a router coupled to said local memory controller, said 3D engine, said graphics BLT engine, and said display engine, which interacts with an operating system (OS) to transform requests into memory addresses of said local memory for executing said BLT operation;

a command decoder which decodes user commands, including a BLT command, and issues threads of control to said local memory controller, said 3D engine, said graphics BLT engine, and said display engine; and an interface which provides an interface for communications or signals to/from one or more processors.

29. The mechanism as claimed in claim 25, wherein said designated pattern of the graphics surface corresponds to a checkerboard with ½ of said checkerboard allocated to one graphics engine and the other ½ of said checkerboard allocated to the other graphics engine.

30. The mechanism as claimed in claim 25, wherein said BLT operation includes a logical operation on pixel data of said source and other OPERAND(s) to obtain pixel data of said destination on the graphics surface.

* * * * *